US008124563B2

(12) United States Patent
Oguma et al.

(10) Patent No.: US 8,124,563 B2
(45) Date of Patent: Feb. 28, 2012

(54) HEAT-SENSITIVE TRANSFER IMAGE-RECEIVING SHEET

(75) Inventors: Kazuaki Oguma, Minami-ashigara (JP); Yasufumi Nakai, Minato-ku (JP); Hideyuki Shirai, Minami-ashigara (JP)

(73) Assignee: Fujifilm Corporation, Tokyo (JP)

( * ) Notice: Subject to any disclaimer, the term of this patent is extended or adjusted under 35 U.S.C. 154(b) by 493 days.

(21) Appl. No.: 12/360,440

(22) Filed: Jan. 27, 2009

(65) Prior Publication Data

US 2009/0191364 A1 Jul. 30, 2009

(30) Foreign Application Priority Data

Jan. 28, 2008 (JP) ..... 2008-016968

(51) Int. Cl.
*B41M 5/035* (2006.01)
*B41M 5/50* (2006.01)

(52) U.S. Cl. ..... 503/227; 428/32.39

(58) Field of Classification Search ..... None
See application file for complete search history.

(56) References Cited

FOREIGN PATENT DOCUMENTS

| | | | |
|---|---|---|---|
| JP | 5-8572 | A | 1/1993 |
| JP | 3226167 | B2 | 8/2001 |
| JP | 2006-88691 | A | 4/2006 |
| JP | 2006-130810 | A | 5/2006 |
| JP | 2006-264092 | A | 10/2006 |
| JP | 2007-237617 | * | 9/2007 |

* cited by examiner

*Primary Examiner* — Bruce H Hess
(74) *Attorney, Agent, or Firm* — Sughrue Mion, PLLC

(57) ABSTRACT

A heat-sensitive transfer image-receiving sheet having at least one heat insulation layer and at least one receptor layer on a support, the heat insulation layer containing at least one hollow polymer, and the receptor layer containing at least one latex polymer having the glass transition temperature (Tg) of 20° C. to 60° C. and at least one polymer compound having an aliphatic group substituted with a fluorine atom at its side chain.

7 Claims, No Drawings

HEAT-SENSITIVE TRANSFER IMAGE-RECEIVING SHEET

FIELD OF THE INVENTION

The present invention relates to a heat-sensitive transfer image-receiving sheet, and in more detail, it relates to a heat-sensitive transfer image-receiving sheet that is prevented from crack at the time of drying after coating, and that is free from the image defects such as a white deletion at a low density portion and a non-uniformity of density at a high density portion, each of which is caused by the crack.

BACKGROUND OF THE INVENTION

In this dye diffusion transfer recording system, a heat-sensitive transfer sheet (hereinafter also referred to as an ink sheet) containing dyes is superposed on a heat-sensitive transfer image-receiving sheet (hereinafter also referred to as an image-receiving sheet), and then the ink sheet is heated by a thermal head whose exothermic action is controlled by electric signals, in order to transfer the dyes contained in the ink sheet to the image-receiving sheet, thereby recording an image information. Three colors: cyan, magenta, and yellow, are used for recording a color image by overlapping one color to other, thereby enabling transferring and recording a color image having continuous gradation for color densities.

In such a recording method in dye diffusion transfer system, it has been known that it is important to make the image-receiving sheet have high heat insulation and cushion characteristics in order to give a favorable image.

Thus, in some cases, a composite support using a biaxial oriented (stretched) polyolefin film containing microvoids was used as a base material for the image-receiving sheet to make the sheet have more heat insulation and cushion characteristics. However in this method, there was occasionally caused a problem that the image-receiving sheet was wrinkled or curled by shrinkage due to relaxation of the residual stress after stretching by the heat during printing or the heat during formation of the image-receiving layer.

As other known methods of making the image-receiving sheet show heat insulation and cushion properties, a method in which, for example, a foaming layer composed of a resin and a foaming agent (see, e.g., Japanese Patent No. 2541796) or a heat insulation layer made of a micro-capsular hollow polymer and an organic solvent-resistant polymer as principal components (see, e.g., Japanese Patent No. 3226167) each having high cushion characteristics is formed between the support and the receptor layer, is known. The methods have an advantage that it is possible to prevent the image-receiving sheet from wrinkling and curling that are often found in the method in which the composite support, because a heat-insulating layer can be formed on a support by coating according to the method. However, it is generally difficult to produce a uniform smooth image-receiving sheet often causing problems such as bad image-transfer, a white deletion, a rough surface, and a deficient contact with a protective layer. To solve the problems described above, a method in which a solution for forming an intermediate layer is coated on a sheet-shaped support and an image-receiving sheet is formed while pressing the coated face to a cast drum in forming an intermediate layer of a resin containing hollow polymers as the principal component on the sheet-shaped support, is disclosed (see, e.g., JP-A-5-8572 ("JP-A" means unexamined published Japanese patent application)). However, although such a method is effective in giving sufficient smoothness, it makes the production process more complicated and is thus disadvantageous from the viewpoint of productivity.

To solve the aforementioned problems, for example, a heat-sensitive transfer image-receiving sheet containing a heat insulation layer and a receptor layer disposed on a support wherein the heat insulation layer contains a hollow polymer having a content of 65% by mass or more, and wherein the heat insulation layer and a adjacent layer at the receptor layer side are formed by a simultaneous multi-coating, is disclosed (see JP-A-2006-88691). In this solution, a high filling factor is required to achieve a sufficient heat insulating effect, which results in a coating solution having a high content of the hollow polymer. When coating solutions having a different volume shrinkage rate from each other at the time of drying, such as a coating solution containing a bulky solid material having voids inside and a latex coating solution free from voids inside, are applied by a simultaneous multi-coating, the surface of a coated film cracks after drying because of the different volume shrinkage rate at the time of drying during the coarse of drying after coating. Consequently, there was a problem relating to the image defects such as a white deletion at a low density portion and a non-uniformity of density at a high density portion.

Beside, a heat-sensitive transfer image-receiving sheet containing a heat insulation layer and a receptor layer disposed on a support wherein the heat insulation layer contains a hollow polymer having a content of 40% by mass or more, and the receptor layer contains a vinyl chloride/vinyl acetate copolymer emulsion or a vinyl chloride/acrylic compound copolymer emulsion, is disclosed (see JP-A-2006-264092). In a method of producing the image-receiving sheet as proposed in the above publication, the heat insulation layer and the receptor layer are formed by a sequential coating. However, the heat insulation layer is composed of a hollow polymer having such a high filling factor that even voids formed among hollow polymer particles are also used in order to achieve a sufficiently heat insulating effect. Therefore, when a layer at the receptor layer side is applied on the heat insulation layer by the sequential coating, a coating solution of the layer at the receptor layer side penetrates to the voids formed among hollow polymer particles in the outermost surface of the heat insulation layer that functions most efficiently as a heat insulation layer, which results in a problem of reduction in the heat insulating effect.

From the aforementioned background, it has been earnestly desired to develop a heat-sensitive transfer image-receiving sheet capable of achieving high density print characteristics by making the best use of the voids among hollow polymer particles that is accomplished by the simultaneous multi-coating, and also capable of realizing an excellent smoothness free from the crazing by the simultaneous multi-coating of the coating solutions having a different volume shrinkage rate from each other. As a solution for eliminating the irregularity of the coating, a method of producing a thermal transfer sheet in which uniformity of the coating is achieved by controlling viscosity of the coating solution, is disclosed (see JP-A-2006-130810). However, this publication only describes an invention directed to a single layer, and there is no reference to both occurrence and solution of the crack owing to the simultaneous multi-coating.

SUMMARY OF THE INVENTION

The present invention resides in a heat-sensitive transfer image-receiving sheet having at least one heat insulation layer and at least one receptor layer on a support, the heat insulation layer containing at least one hollow polymer, and the receptor layer containing at least one latex polymer having the glass transition temperature (Tg) of 20° C. to 60° C. and at least one polymer compound having an aliphatic group substituted with a fluorine atom at its side chain Other and further features and advantages of the invention will appear more fully from the following description.

DETAILED DESCRIPTION OF THE INVENTION

According to the present invention, there is provided the following means:

(1) A heat-sensitive transfer image-receiving sheet having at least one heat insulation layer and at least one receptor layer on a support, the heat insulation layer containing at least one hollow polymer, and the receptor layer containing at least one latex polymer having the glass transition temperature (Tg) of 20° C. to 60° C. and at least one polymer compound having an aliphatic group substituted with a fluorine atom (hereinafter, referred to as "a fluorine aliphatic group") at its side chain.

(2) The heat-sensitive transfer image-receiving sheet described in (1), wherein the polymer compound having fluorine atom-substituted aliphatic groups on the side chains is nonionic.

(3) The heat-sensitive transfer image-receiving sheet described in (1) or (2), wherein the polymer compound having fluorine atom-substituted aliphatic groups on the side chains is soluble in water.

(4) The heat-sensitive transfer image-receiving sheet as described in any one of (1) to (3), wherein the receptor layer further contains a water-soluble polymer.

(5) The heat-sensitive transfer image-receiving sheet as described in any one of (1) to (4), wherein the polymer latex is a vinyl chloride-series copolymer.

(6) The heat-sensitive transfer image-receiving sheet as described in any one of (1) to (5), a layer of which contains a hardener.

(7) The heat-sensitive transfer image-receiving sheet as described in any one of (1) to (6), wherein the heat insulation layer contains at least one polymer having the glass transition temperature (Tg) of 20° C. to 80° C.

The present invention can provide an image-receiving sheet of high image quality for heat-sensitive transfer recording that has improved image defects such as a white deletion at a low density portion, a non-uniformity of density at a high density portion, and a transfer irregularity of a protective layer, each of which is caused by the crack owing to a difference of volume shrinkage rate in the previous heat-sensitive transfer image-receiving sheet.

The heat-sensitive transfer image-receiving sheet of the present invention will be explained in detail below.

The heat-sensitive transfer image-receiving sheet of the present invention has at least one heat insulation layer and at least one receptor layer on a support, the heat insulation layer containing at least one hollow polymer, and the receptor layer containing at least one latex polymer having the glass transition temperature (Tg) of 20° C. to 60° C. and at least one polymer compound having an aliphatic group substituted with a fluorine atom at its side chain.

The polymer latex in the receptor layer is used for reception of a dye. Further, the receptor layer may contain a water-soluble polymer, an ultraviolet absorbing agent, a sliding agent, an antioxidant, antiseptics, a surfactant, or the like. Moreover, it is preferable that the heat-sensitive thermal transfer image-receiving sheet used in the present invention is provided with at least one heat insulation layer (porous layer) between the support and the receptor layer. An intermediate layer such as a gloss-control layer, a white-background-control layer, a charge-control layer (an electrification-control layer), an adhesive layer, and a primer layer, may be provided between the receptor layer and the support.

When the heat insulation layer is provided, the receptor layer, the heat insulation layer and the intermediate layer are preferably formed by a simultaneous multi-layer coating. When the intermediate layer is provided, the receptor layer, the heat insulation layer, and the intermediate layer may be formed by the simultaneous multi-layer coating. The receptor layer, the heat insulation layer, and the other layer are preferably formed by a simultaneous multilayer coating. Further, in order to make the heat insulation layer exhibit its best heat insulating effect, it is preferable to dispose the receptor layer and the heat insulation layer without disposing an intermediate layer between them, so that the receptor layer and the heat insulation layer directly contact with each other.

A curling control layer, a writing layer, or a charge-control layer may be formed on the backside of the support. Each of these layers is applied, using a usual method, such as a roll coating, a bar coating, a gravure coating, and a gravure reverse coating.

First, a polymer compound having an aliphatic group substituted with a fluorine atom (hereinafter, referred to as "a fluorine atom-substituted aliphatic group") at its side chain in the receptor layer is explained in detail.

The polymer compound having a fluoro aliphatic group at its side chain can be derived from a fluoro aliphatic compound produced by a telomerization method that is also called a telomer method, or an oligomerization method that is also called an oligomer method. The fluoro aliphatic compound can be synthesized by a method described in the publication of JP-A-2002-90991.

The fluorine atom-substituted aliphatic group is an aliphatic group (straight-chain, branched or cyclic aliphatic group), preferably an alkyl, alkenyl or cycloalkynyl group having 1 to 36 carbon atoms, having at least one substituted fluorine atom, more preferably an alkyl group having 1 to 36 carbon atoms (preferably 1 to 18, more preferably 1 to 12, furthermore preferably 1 to 10, most preferably 4 to 8) having at least one substituted fluorine atom, and the aliphatic group may be substituted additionally with groups other than fluorine atom. Examples of the substituent groups include alkyl groups, aryl groups, heteroring groups, halogen atoms other than fluorine atom, a hydroxyl group, alkoxy groups, aryloxy groups, alkylthio groups, arylthio groups, an amino group, alkylamino groups, arylamino groups, heteroring amino groups, acylamino groups, sulfone amino groups, carbamoyl groups, sulfamoyl groups, a cyano group, a nitro group, acyl groups, sulfonyl groups, ureido groups, urethane groups and the like.

In the present invention, the fluorine atom-substituted aliphatic group is most preferably a perfluoroalkyl group.

The polymer compound having fluorine atom-substituted aliphatic groups on the side chains is preferably a polymer or copolymer of a fluorine atom-substituted aliphatic group-containing monomer, and examples of the favorable monomers thereof include acrylic acid derivatives (e.g., acrylic acids, acrylic esters, and acrylamides, preferably acrylic esters and acrylamides, more preferably acrylic esters) and methacrylic acid derivatives (e.g., methacrylic acids, methacrylic esters, and methacrylamides, preferably methacrylic esters and methacrylamides, more preferably methacrylic esters) having an acyl, alcohol or amide group (substituent group on nitrogen atom) substituted with a fluorine atom-substituted aliphatic group; and acrylonitrile derivatives having a fluorine atom-substituted aliphatic group.

In the case where the polymer compound having fluorine atom-substituted aliphatic groups on the side chains is a copolymer with a fluorine atom-substituted aliphatic group-containing monomer, examples of the monomers used in combination include acrylates, methacrylates, acrylonitriles, acrylamides, methacrylamides, olefins, styrenes, and the like, and in particular; acrylates, methacrylates, acrylonitriles, acrylamides, and methacrylamides are preferable; acrylates and methacrylates are more preferable; and among them, those having a polyoxyalkylene (e.g., polyoxyethylene, polyoxypropylene) unit in the group substituted on the alcohol group or the amide nitrogen atom are preferable.

In the present invention, the polymer above is preferably a copolymer, which may be a binary copolymer or a ternary or higher copolymer.

As the polymers having a fluorine atom-substituted aliphatic group at its side chain, preferred are copolymers of a monomer having a fluorine atom-substituted aliphatic group and poly(oxyalkylene)acrylate and/or poly(oxyalkylene) methacrylate. They may be distributed irregularly, or block polymerized. Examples of the poly(oxyalkylene) group include poly(oxyethylene) group, poly(oxypropylene) group, and poly(oxybutylene) group. Further, the poly(oxyalkylene) group may be an unit having alkylene groups of chain lengths different from each other in the same chain length, such as poly(block connector of oxyethylene and oxypropylene and oxyethylene) and poly(block connector of oxyethylene and oxypropylene). Further, the copolymer of a monomer having a fluoro aliphatic group and poly(oxyalkylene)acrylate or methacrylate is not limited to binary copolymers, but may be ternary or more multiple copolymers that can be produced by copolymerizing, at the same time, several different co-monomers such as monomers having two or more different fluoro aliphatic groups and two or more different kinds of poly (oxyalkylene)acrylate or methacrylate.

An average molecular weight of the polymers having a fluorine atom-substituted aliphatic group at its side chain ranges from 5,000 to 50,000, preferably from 8,000 to 30,000, and more preferably from 10,000 to 20,000.

Examples of the copolymers include copolymers of acrylate (or methacrylate) having a perfluorobutyl group (—$C_4F_9$) and poly(oxyalkylene)acrylate (or methacrylate), copolymers of acrylate (or methacrylate) having a $C_4F_9$ group, poly (oxyethylene)acrylate (or methacrylate) and poly(oxypropylene)acrylate (or methacrylate), copolymers of acrylate (or methacrylate) having a perfluorohexyl group (—$C_6F_{13}$) and poly(oxyalkylene)acrylate (or methacrylate), copolymers of acrylate (or methacrylate) having a $C_6F_{13}$ group, poly(oxyethylene)acrylate (or methacrylate) and poly(oxypropylene) acrylate (or methacrylate), copolymers of acrylate (or methacrylate) having a $C_8F_{17}$ group and poly(oxyalkylene) acrylate (or methacrylate), and copolymers of acrylate (or methacrylate) having a perfluoroctyl group (—$C_8F_{17}$), poly (oxyethylene)acrylate (or methacrylate) and poly(oxypropylene)acrylate (or methacrylate).

Further, the polymer compound having a fluorine atom-substituted aliphatic group at its side chain is commercially available referring to a general name such as "perfluoroalkyl-containing oligomer". For example, the following products can be used. As the products of Dainippon Ink & Chemicals Incorporated, there are Megafac F-470, Megafac F-471, Megafac F-472SF, Megafac F-474, Megafac F-475, Megafac F-477, Megafac F-478, Megafac F-479, Megafac F-480SF, Megafac F-472, Megafac F-483, Megafac F-484, Megafac F-486, Megafac F-487, Megafac F-489, Megafac F-172D, Megafac F-178K, Megafac F-178RM (each product name). As the products of Sumitomo 3 M Limited, there are Novec™ FC-4430 and FC-4432 (each product name).

The polymer compound having fluorine atom-substituted aliphatic groups on the side chains is preferably a nonionic compound (having no dissociable group in water such as sulfo or carboxyl group), and more preferably, it is water-soluble to a certain degree. The phrase "water soluble to a certain degree" means that the polymer compound has solubility in pure water of 1% or more at 25° C. Specifically, the polymer is, for example, a polymer compound having hydroxyl groups or the oxyalkylene groups described above, and favorable examples thereof include water-soluble compounds such as Megafac F-470, Megafac F-472SF, Megafac F-477, Megafac F-479, Megafac F-480SF, Megafac F-484, and Megafac F-486 (all trade names, manufactured by Dainippon Ink and Chemicals, Inc.).

The reason why the polymer compound having fluorine atom-substituted aliphatic groups on the side chains is preferably nonionic and soluble in water to a certain degree is not yet to be understood, but is likely the followings. The nonionic polymer compound having fluorine atom-substituted aliphatic groups on the side chains is favorably compatible with the dye and the binder in the thermal transfer layer. On the other hand, the polymer compound, which is favorably compatible, because of its water solubility, with the receiving layer of the heat-sensitive transfer image-receiving sheet prepared by using a latex. Thus, it seems to emanate into the interface between the heat-sensitive transfer sheet and the heat-sensitive transfer image-receiving sheet during printing under high-temperature high-humidity condition, where it shows its releasing action effectively.

The addition amount of the polymer compound having fluorine atom-substituted aliphatic groups on the side chains is preferably 0.2 mass % to 10 mass %, more preferably, 0.5 mass % to 8 mass %, and still more preferably 1 mass % to 5 mass %, with respect to the total solid (mass) in the thermal transfer layer. The addition of one kind of polymer compound having fluorine atom-substituted aliphatic groups the polymer compound having fluorine atom-substituted aliphatic groups on the side chains may have an effect. The usage of two kinds of polymer compounds having a fluorine aliphatic group at its side chain in combination made the effects of the present invention enhance.

The receptor layer for use in the present invention contains the latex polymer having the glass transition temperature of 20° C. to 60° C. The glass transition temperature (Tg) of the latex polymer is preferably 25° C. to 55° C., and more preferably 25° C. to 50° C. When the latex polymer having the glass transition temperature of above 60° C., the addition of the polymer compound having fluorine atom-substituted aliphatic groups does not have a sufficient effect, because of high glass transition temperature (Tg). On the other hand, it is not preferable to use the glass transition temperature (Tg) of below 20° C. for bad image storability.

The latex polymer is generally a dispersion of fine particles of thermoplastic resin in a water-soluble dispersion medium. Examples of the thermoplastic resins used for the latex polymer according to the present invention include polycarbonates, polyesters, polyacrylates, vinyl chloride copolymers, polyurethane, styrene-acrylonitrile copolymers, polycaprolactone and the like.

Among them, polycarbonates, polyesters, and vinyl chloride copolymers are preferable, polyesters and vinyl chloride copolymer are particularly preferable, vinyl chloride copolymer is most preferable.

The polyester polymers are obtained by polycondensation of a dicarboxylic acid component (including a derivative thereof) and a diol component (including a derivative thereof). The polyester polymers preferably contain an aromatic ring and/or an aliphatic ring. The polyester polymers may contain a solvable group to promote their dispersion.

The vinyl chloride copolymer is a copolymer contains a vinyl chloride as essential monomer with other monomer. Examples of the vinyl chloride copolymers include vinyl chloride-vinyl acetate copolymers, vinyl chloride-acrylate copolymers, vinyl chloride-methacrylate copolymers, vinyl chloride-vinyl acetate-acrylate copolymers, vinyl chloride-acrylate-ethylene copolymers and the like. As described above, it may be a binary copolymer or a ternary or higher copolymer, and the monomers may be distributed randomly or uniformly by block copolymerization.

The copolymer may contain auxiliary monomer components such as vinylalcohol derivatives, maleic acid derivatives, and vinyl ether derivatives. The copolymer preferably contain vinyl chloride components in an amount of 50 mass % or more, and auxiliary monomer components such as maleic acid derivative and vinyl ether derivative in an amount of 10 mass % or less.

The latex polymers may be used alone or as a mixture. The latex polymer may have a uniform structure or a core/shell structure, and in the latter case, the resins constituting the core and shell respectively may have different glass transition temperatures.

Examples of the commercially available acrylic-series polymers include Nipol LX814 (Tg:25° C.) and Nipol LX852X2 (Tg:43° C.) (trade names, manufactured by Nippon Zeon Co., Ltd.).

Examples of the commercially available polyesters include Bironal MD-1100 (Tg:40° C.), MD-1400 (Tg:20° C.), MD-1480 (Tg:20° C.), and MD-1985 (Tg:20° C.) (trade names, manufactured by Toyobo Co., Ltd.).

Examples of the commercially available vinyl chlorides copolymers include VINYBLAN 276 (Tg:33° C.), and 609 (Tg:46° C.) (trade names, manufactured by Nissin Chemical Industry Co., Ltd.), and Sumielite 1320 (Tg:40° C.) and 1210 (Tg:30° C.) (trade names, manufactured by Sumika Chemtex Co., Ltd.). (Tg is represented by the glass transition temperature.)

The addition amount of the latex polymer (latex polymer solid content) is preferably 50 to 98 mass %, more preferably 70 to 95 mass %, with respect to all polymers in the receiving layer. The latex polymer preferably have a mean average particle size (diameter) of about 1 to 50,000 nm, more preferably about 5 to 1,000 nm.

The receiving layer of the heat-sensitive transfer image-receiving sheet may contain a polymer compound identical with or different in kind from the polymer compound having fluorine atom-substituted aliphatic groups on the side chains described above. It may also contain, as releasing agent, a known polyethylene wax, a solid wax such as amide wax, a silicone oil, a phosphate ester compound, a fluorochemical surfactant or a silicone-based surfactant.

In the heat-sensitive transfer image-receiving sheet of the present invention, the heat insulation layer contains a hollow polymer.

The hollow polymer in the present invention is a polymer particle having voids inside of the particle. The hollow polymer particle is preferably aqueous dispersion. Examples of the hollow polymer particles include (1) non-foaming type hollow particles obtained in the following manner: a dispersion medium such as water is contained inside of a capsule wall formed of a polystyrene, acrylic resin, or styrene/acrylic resin, and, after a coating liquid is applied and dried, the water in the particles is vaporized out of the particles, with the result that the inside of each particle forms a hollow; (2) foaming type microballoons obtained in the following manner: a low-boiling-point liquid such as butane and pentane, is encapsulated in a resin constituted of any one of polyvinylidene chloride, polyacrylonitrile, polyacrylic acid, and polyacrylate, or their mixture or polymer, and after the resin coating material is applied, it is heated to expand the low-boiling-point liquid inside of the particles, whereby the inside of each particle is made to be hollow; and (3) microballoons obtained by foaming the above (2) under heating in advance, to make hollow polymer particles.

Specific examples of the above (1) include Rohpake 1055, manufactured by Rohm and Haas Co.; Boncoat PP-1000, manufactured by Dainippon Ink and Chemicals, Incorporated; SX866(B), manufactured by JSR Corporation; and Nippol MH5055, manufactured by Nippon Zeon (all of these product names are trade names). Specific examples of the above (2) include F-30, and F-50, manufactured by Matsumoto Yushi-Seiyaku Co., Ltd. (all of these product names are trade names). Specific examples of the above (3) include F-30E, manufactured by Matsumoto Yushi-Seiyaku Co., Ltd, and Expancel 461DE, 551DE, and 551DE20, manufactured by Nippon Ferrite (all of these product names are trade names).

Of these, non-foaming hollow polymer particles of the foregoing (1) are preferred. If necessary, use can be made of a mixture of two or more kinds of polymer particles.

The average particle diameter (particle size) of the hollow polymer particles is preferably 0.1 to 5.0 μm, more preferably 0.2 to 3.0 μm, and particularly preferably 0.4 to 2.0 μm.

The hollow ratio (percentage of void) of the hollow polymer particles is preferably in the range of from about 20% to about 70%, and particularly preferably from 30% to 65%.

In the present invention, the particle size of the hollow polymer particle is calculated after measurement of the circle-equivalent diameter of the periphery of particle under a transmission electron microscope. The average particle diameter is determined by measuring the circle-equivalent diameter of the periphery of at least 300 hollow polymer particles observed under the transmission electron microscope and obtaining the average thereof. The hollow ratio of the hollow polymer particles is calculated by the ratio of the volume of voids to the volume of a particle.

The glass transition temperature (Tg) of the hollow polymer that can be used in the heat-sensitive transfer image-receiving sheet of the present invention is preferably 70 to 200° C., more preferably 90 to 180° C. The hollow polymer is preferably a hollow latex polymer.

The heat insulation layer containing a hollow polymer further contains, as a binder, a polymer resin having a glass transition temperature (Tg) in the range from 20° C. to 80° C. with a preferable range of from 25° C. to 75° C.

A preferably exemplified binder that is used for the aqueous coating necessary to the present invention is latex polymer as set forth below. The latex may be used solely or in a mixture.

A thickness of the heat insulation layer containing the hollow polymer particles is preferably from 5 to 50 μm, more preferably from 5 to 40 μm.

In the present invention, it is preferred that the heat insulation layer containing a hollow polymer contains hollow polymer particles with a solid content of 50% or more after drying, with more preferable solid content of 60% or more. The upper limit of the solid content by mass is preferably 95% or less. If the solid content by mass is too low, both sensitivity and density reduce owing to lack of heat insulation property.

On the other hand, when the solid content by mass is too high, crazing occurs owing to a short of binder. However, there is practically no problem.

The heat insulation layer according to the present invention preferably contains a polymer resin having a glass transition temperature (Tg) in the range from 20° C. to 80° C. The resin herein used is preferably water-dispersed latex from a viewpoint of aqueous coating. There is no particular limitation to the kind (for example, species, compositions, and molecular weight) of the polymer resin itself. Trade names of various kinds of latex polymer are exemplified below. However, the present invention is not intended to be limited thereto.

Examples of the acrylic-series polymers include Nipol LX855 (P-17: Tg 36° C.), and 857X2 (P-18: Tg 43° C.) (trade names, manufactured by Nippon Zeon Co., Ltd.); Voncoat R3370 (P-19: Tg 25° C.) (trade name, manufactured by Dai-Nippon Ink & Chemicals, Inc.); Julimer ET-410 (P-21: Tg 44° C.) (trade name, manufactured by Nihon Junyaku K.K.); AE116 (P-22: Tg 50° C.), AE119 (P-23: Tg 55° C.), AE121 (P-24: Tg 58° C.), AE125 (P-25: Tg 60° C.), AE134 (P-26: Tg 48° C.), AE137 (P-27: Tg 48° C.), AE140 (P-28: Tg 53° C.), and AE173 (P-29: Tg 60° C.) (trade names, manufactured by JSR Corporation), and Aron A-104 (P-30: Tg 45° C.) (trade name, manufactured by Toagosei Co., Ltd.).

Examples of the polyesters include FINETEX ES650, 611, 675, and 850 (trade names, manufactured by Dainippon Ink and Chemicals, Incorporated); WD-size, and WMS (trade names, manufactured by Eastman Chemical Ltd.); A-110, A-115GE, A-120, A-121, A-124GP, A-124S, A-160P, A-210, A-215GE, A-510, A-513E, A-515GE, A-520, A-610, A-613, A-615GE, A-620, WAC-10, WAC-15, WAC-17XC, WAC-20, S-110, S-110EA, S-111SL, S-120, S-140, S-140A, S-250, S-252G, S-250S, S-320, S-680, DNS-63P, NS-122L, NS-122LX, NS-244LX, NS-140L, NS-141LX, and NS-282LX (trade names, manufactured by Takamatsu Yushi K.K.); Aronmelt PES-1000 series, and PES-2000 series (trade names, manufactured by Toagosei Co., Ltd.); Vylonal MD-1100, MD-1200, MD-1220, MD-1245, MD-1250, MD-1335, MD-1400, MD-1480, MD-1500, MD-1930, and MD-1985 (trade names, manufactured by Toyobo Co., Ltd.); and Ceporjon ES (trade name, manufactured by Sumitomo Seika Chemicals Co., Ltd.).

Examples of the polyurethanes include HYDRAN AP10, AP20, AP30, AP40, and 101H, Vondic 1320NS and 1610NS (trade names, manufactured by Dainippon Ink and Chemicals, Incorporated); D-1000, D-2000, D-6000, D-4000, and D-9000 (trade names, manufactured by Dainichi Seika Color & Chemicals Mfg. Co., Ltd.); NS-155X, NS-310A, NS-310X, and NS-311X (trade names, manufactured by Takamatsu Yushi K.K.); and Elastron (trade name, manufactured by Dai-ichi Kogyo Seiyaku Co., Ltd.).

Examples of the rubbers include LACSTAR 7310K, 3307B, 4700H, and 7132C (trade names, manufactured by Dainippon Ink & Chemicals Incorporated); and Nipol LX416, LX410, LX430, LX435, LX110, LX415A, LX438C, 2507H, LX303A, LX407BP series, V1004, and MH5055 (trade names, manufactured by Nippon Zeon Co., Ltd.).

Examples of polyvinyl chloride polymers include G351 and G576 (trade names, manufactured by Nippon Zeon Co., Ltd.); VINYBLAN 240, 270, 277, 375, 386, 609, 550, 601, 602, 630, 660, 671, 683, 680, 680S, 681N, 685R, 277, 380, 381, 410, 430, 432, 860, 863, 865, 867, 900, 900GT, 938 and 950 (trade names, manufactured by Nissin Chemical Industry Co., Ltd.); S-LEC A, S-LEC C and S-LEC M (trade names, manufactured by Sekisui Chemical Co., Ltd.); and DENKA VINYL 1000GKT, DENKA VINYL 1000L, DENKA VINYL 1000CK, DENKA VINYL 1000A, DENKA VINYL 1000LK2, DENKA VINYL 1000AS, DENKA VINYL 1000GS, DENKA VINYL 1000LT3, DENKA VINYL 1000D and DENKA VINYL 1000W (trade names, manufactured by Denki Kagaku Kogyo Kabushiki Kaisha).

Examples of the polyvinyl acetates include VINYBLAN 1080, 1082, 1085W, 1108W, 1108S, 1563M, 1566, 1570, 1588C, A22J7-F2, 1128C, 1137, 1138, A20J2, A23J1, A23J1, A23K1, A23P2E, A68J1N, 1086A, 1086, 1086D, 1108S, 1187, 1241LT, 1580N, 1083, 1571, 1572, 1581, 4465, 4466, 4468W, 4468S, 4470, 4485LL, 4495LL, 1023, 1042, 1060, 1060S, 1080M, 1084W, 1084S, 1096, 1570K, 1050, 1050S, 3290, 1017AD, 1002, 1006, 1008, 1107L, 1225, 1245L, GV-6170, GV-6181, 4468W, and 4468S (trade names, manufactured by Nissin Chemical Industry Co., Ltd.).

Preferable examples of the latex polymer that can be used in the present invention may include polylactates, polyurethanes, polycarbonates, polyesters, polyacetals, SBR's, and polyvinyl chlorides. It is more preferable to include polyvinyl chlorides, polyesters, polycarbonates, and SBR's among these compounds. It is further preferable to include polyvinyl chlorides, polyesters, and SBR's among these compounds.

These latex polymers may be used singly, or two or more of these polymers may be blended, if necessary.

In the heat-sensitive transfer image-receiving sheet of the present invention, the receptor layer and/or the heat insulation layer may contain a water-soluble polymer. Herein, "water-soluble polymer" means a polymer which dissolves, in 100 g water at 20° C., in an amount of 0.05 g or more, preferably 0.1 g or more, further preferably 0.5 g or more.

Among the water-soluble polymers which can be used in the heat-sensitive transfer image-receiving sheet of the present invention, specific examples include carrageenans, pectins, dextrins, gelatins, caseins, carboxymethylcelluloses, hydroxyethylcelluloses, hydroxypropylcelluloses, polyvinyl pyrrolidone, polyvinyl pyrrolidone copolymers, polyvinyl alcohol, polyethylene glycol, polypropylene glycol, and water-soluble polyesters. Among the natural polymers and the semi-synthetic polymers which can be used in the present invention, gelatin or polyvinyl alcohol is preferable.

Gelatin having a molecular weight of from 10,000 to 1,000,000 may be used in the present invention. Gelatin that can be used in the present invention may contain an anion such as $Cl^-$ and $SO_4^{2-}$, or alternatively a cation such as $Fe^{2+}$, $Ca^{2+}$, $Mg^{2+}$, $Sn^{2+}$, and $Zn^{2+}$. Gelatin is preferably added as an aqueous solution.

The gelatin above may contain a known crosslinking agent such as aldehyde-type crosslinking agent, N-methylol-type crosslinking agent, vinylsulfone-type crosslinking agent, or chlorotriazine-type crosslinking agent. Among the crosslinking agents above, vinylsulfone-type and chlorotriazine-type crosslinking agents are preferable, and typical examples thereof include bisvinylsulfonylmethylether, N,N'-ethylene-bis(vinylsulfonylacetamido)ethane, and 4,6-dichloro-2-hydroxy-1,3,5-triazine or the sodium salt thereof.

As the polyvinyl alcohol, there can be used various kinds of polyvinyl alcohols such as complete saponification products thereof, partial saponification products thereof, and modified polyvinyl alcohols. With respect to these polyvinyl alcohols, those described in Koichi Nagano, et al., "Poval", Kobunshi Kankokai, Inc. are useful.

The viscosity of polyvinyl alcohol can be adjusted or stabilized by adding a trace amount of a solvent or an inorganic salt to an aqueous solution of polyvinyl alcohol, and use may be made of compounds described in the aforementioned reference "Poval", Koichi Nagano et al., published by Kobunshi Kankokai, pp. 144-154. For example, a coated-surface quality can be improved by an addition of boric acid, and the addition of boric acid is preferable. The amount of boric acid to be added is preferably 0.01 to 40 mass %, with respect to polyvinyl alcohol.

Specific examples of the polyvinyl alcohols include completely saponificated polyvinyl alcohol such as PVA-105, PVA-110, PVA-117 and PVA-117H (trade names, manufactured by KURARAY CO., LTD.); partially saponificated polyvinyl alcohol such as PVA-203, PVA-205, PVA-210 and PVA-220 (trade names, manufactured by KURARAY CO., LTD.); and modified polyvinyl alcohols such as C-118, HL-12E, KL-118 and MP-203 (trade names, manufactured by KURARAY CO., LTD.).

<Hardener>

A hardener (hardening agent) may be added in a coating layer(s) (e.g., the receptor layer, the heat insulation layer, the undercoat layer) of the image-receiving sheet of the present invention.

Examples of the hardener that can be used in the present invention include H-1, 4, 6, 8, and 14 in JP-A-1-214845 in page 17; compounds (H-1 to H-54) represented by one of the formulae (VII) to (XII) in U.S. Pat. No. 4,618,573, columns 13 to 23; compounds (H-1 to H-76) represented by the formula (6) in JP-A-2-214852, page 8, the lower right (particularly, H-14); and compounds described in claim 1 in U.S. Pat. No. 3,325,287. Examples of the hardening agent include hardening agents described, for example, in U.S. Pat. No. 4,678,739, column 41, U.S. Pat. No. 4,791,042, JP-A-59-116655, JP-A-62-245261, JP-A-61-18942, and JP-A-4-218044. More specifically, an aldehyde-series hardening agent (formaldehyde, etc.), an aziridine-series hardening agent, an epoxy-series hardening agent, a vinyl sulfone-series hardening agent (N,N'-ethylene-bis(vinylsulfonylacetamido) ethane, etc.), an N-methylol-series hardening agent (dimethylol urea, etc.), boric acid, metaboric acid, or a polymer hardening agent (compounds described, for example, in JP-A-62-234157), can be mentioned.

Preferable examples of the hardener include a vinylsulfone-series hardener and chlorotriazines.

More preferable hardeners in the present invention are compounds represented by the following formula (B) or (C).

$$(CH_2{=}CH{-}SO_2)_n\text{-}L \qquad \text{Formula (B)}$$

$$(X{-}CH_2{-}CH_2{-}SO_2)_n\text{-}L \qquad \text{Formula (C)}$$

In formulae (B) and (C), X represents a halogen atom, L represents an organic linking group having n-valency. When the compound represented by formula (B) or (C) is a low-molecular compound, n denotes an integer of from 1 to 4. When the compound represented by formula (B) or (C) is a high-molecular (polymer) compound, L represents an organic linking group containing a polymer chain, and n denotes an integer within the range of from 10 to 1,000.

In the formulae (B) and (C), X is preferably a chlorine atom or a bromine atom, and further preferably a bromine atom. n is an integer of from 1 to 4, preferably an integer of from 2 to 4, more preferably 2 or 3, and most preferably 2.

L represents an organic group having n-valency, and preferably an aliphatic hydrocarbon group, an aromatic hydrocarbon group, or a heterocyclic group, in which these groups may be further linked through an ether bond, ester bond, amide bond, sulfonamide bond, urea bond, urethane bond, or the like. Also, each of these groups may have a substituent. Examples of the substituent include a halogen atom, an alkyl group, an aryl group, a heterocyclic group, a hydroxyl group, an alkoxy group, an aryloxy group, an alkylthio group, an arylthio group, an acyloxy group, an alkoxycarbonyl group, a carbamoyloxy group, an acyl group, an acyloxy group, an acylamino group, a sulfonamido group, a carbamoyl group, a sulfamoyl group, a sulfonyl group, a phosphoryl group, a carboxyl group, and a sulfo group. Among these groups, a halogen atom, an alkyl group, a hydroxy group, an alkoxy group, an aryloxy group, and an acyloxy group are preferable.

Specific examples of the vinylsulfone-series hardener include the following compounds (VS-1) to (VS-27), but not limited to those in the present invention.

(VS-1)

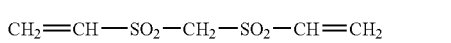

(VS-2)

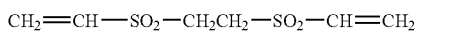

(VS-3)

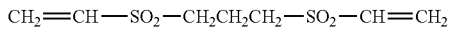

(VS-4)

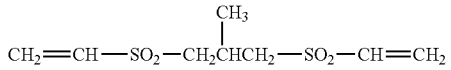

(VS-5)

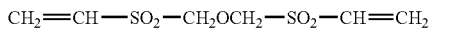

(VS-6)

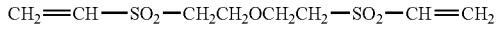

(VS-7)

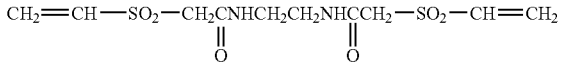

(VS-8)

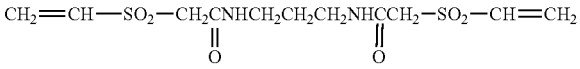

(VS-9)

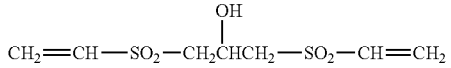

(VS-10)

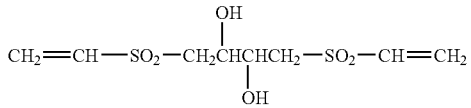

(VS-11)

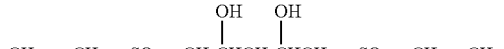

(VS-12)

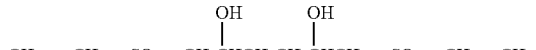

(VS-13)

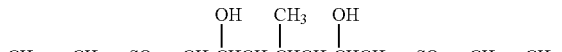

(VS-14)

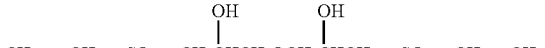

(VS-15)

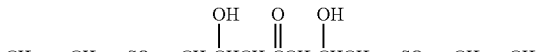

(VS-16)

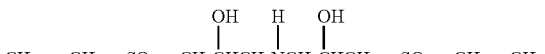

-continued (VS-17)

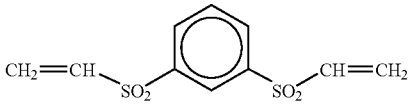

(VS-18)

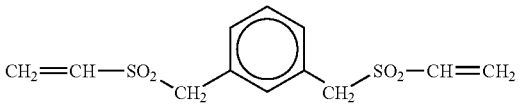

(VS-19)

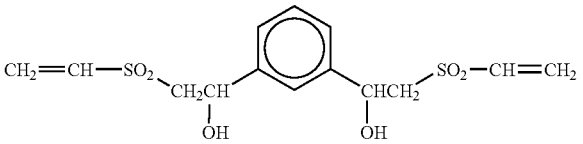

(VS-20)

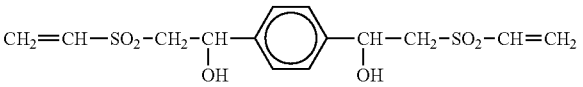

(VS-21)

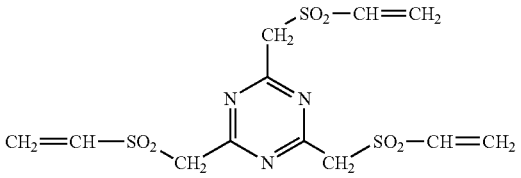

(VS-22)

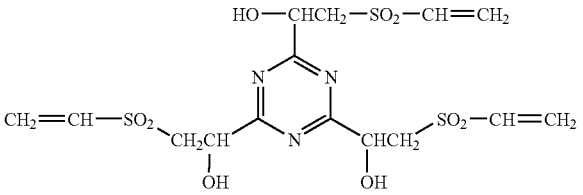

(VS-23)

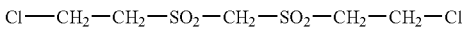

(VS-24)

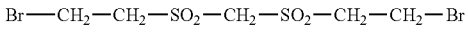

(VS-25)

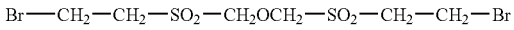

(VS-26)

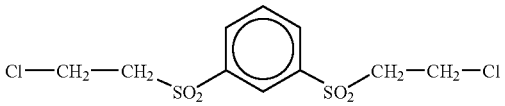

(VS-27)

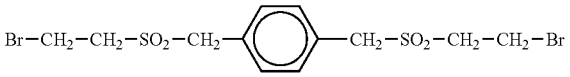

These hardeners may be obtained with reference to the method described in, for example, U.S. Pat. No. 4,173,481.

Furthermore, as the chlorotriazine-series hardener, a 1,3,5-triazine compound in which at least one of the 2-position, 4-position and 6-position of the triazine ring in the compound is substituted with a chlorine atom, is preferable.

A 1,3,5-triazine compound in which two or three of the 2-position, 4-position and 6-position of the triazine ring each are substituted with a chlorine atom, is more preferable. Alternatively, use may be made of a 1,3,5-triazine compound in which at least one of the 2-position, 4-position and 6-position of the triazine ring is substituted with a chlorine atom, and the remainder position(s) is/are substituted with a group(s) or atom(s) other than a chlorine atom. Examples of the group or atom other than chlorine atom include a hydrogen atom, a bromine atom, a fluorine atom, an iodine atom, an alkyl group, an alkenyl group, an alkynyl group, a cycloalkyl group, a cycloalkenyl group, an aryl group, a heterocyclic group, a hydroxy group, a nitro group, a cyano group, an amino group, a hydroxylamino group, an alkylamino group, an arylamino group, a heterocyclic amino group, an acylamino group, a sulfonamido group, a carbamoyl group, a sulfamoyl group, a sulfo group, a carboxyl group, an alkoxy group, an alkenoxy group, an aryloxy group, a heterocyclic oxy group, an acyl group, an acyloxy group, an alkyl- or aryl-sulfonyl group, an alkyl- or aryl-sulfinyl group, an alkyl- or aryl-sulfonyloxy group, a mercapto group, an alkylthio group, an alkenylthio group, an arylthio group, a heterocyclic thio group, and an alkyloxy- or aryloxy-carbonyl group.

Specific examples of the chlorotriazine-series hardener include 4,6-dichloro-2-hydroxy-1,3,5-triazine or its Na salt, 2-chloro-4,6-diphenoxytriazine, 2-chloro-4,6-bis[2,4,6-trimethylphenoxy]triazine, 2-chloro-4,6-diglycidoxy-1,3,5-triazine, 2-chloro-4-(n-butoxy)-6-glycidoxy-1,3,5-triazine, 2-chloro-4-(2,4,6-trimethylphenoxy)-6-glycidoxy-1,3,5-triazine, 2-chloro-4-(2-chloroethoxy)-6-(2,4,6-trimethylphenoxy)-1,3,5-triazine, 2-chloro-4-(2-bromoethoxy)-6-(2,4,6-trimethylphenoxy)-1,3,5-triazine, 2-chloro-4-(2-di-n-butylphosphatoethoxy)-6-(2,4,6-trimethylphenoxy)-1,3,5-triazine, and 2-chloro-4-(2-di-n-butylphosphatoethoxy)-6-(2,6-xylenoxy)-1,3,5-triazine, but the present invention is not limited to those.

Such a compound can be easily produced by reacting cyanur chloride (namely, 2,4,6-trichlorotriazine) with, for example, a hydroxy compound, thio compound or amino compound corresponding to the substituent to be introduced on the heterocycle.

These hardeners are used in an amount of generally 0.001 to 1 g, preferably 0.005 to 0.5 g, per 1 g of the water-soluble polymer.

The heat-sensitive transfer sheet will be explained in detail below.

The heat-sensitive transfer sheet for use in the present invention has a substrate and a thermal transfer layer containing a diffusion transfer dye formed thereon, and preferably has an additional transfer protective-layer laminate, for forming a protective layer of a transparent resin on the thermally transferred image and thus covering and protecting the image formed on the same substrate.

In the heat-sensitive transfer sheet for use in the present invention, preferably, thermal transfer layers (hereinafter also referred to as a heat-sensitive transfer layers or a dye layers) in individual colors of yellow, magenta and cyan, and an optional thermal transfer layer in black are repeatedly painted onto a single support in area order in such a manner that the colors are divided from each other. An example of the thermal transfer layer is an embodiment wherein thermal transfer layers in individual colors of yellow, magenta and cyan are painted onto a single support along the long axial direction thereof in area order, correspondingly to the area of the recording surface of the above-mentioned heat-sensitive transfer image-receiving sheet, in such a manner that the colors are divided from each other. Another example thereof is an embodiment wherein not only the three layers but also a thermal transfer layer in black. It is preferred to give marks in order to inform the printer about starting point of the individual colors.

The thermal transfer layer contains at least a sublimation type dye and a binder resin. It is a preferable embodiment of the present invention that the thermal transfer layer may contains waxes, silicone resins, polymer particles, and inorganic particles, in accordance with necessity.

Each dye in the thermal transfer layer is preferably contained in an amount of 20 to 80 mass % of the dye layer, preferably in that of 30 to 70 mass % thereof.

The coating of the thermal transfer layer is performed by an ordinary method such as roll coating, bar coating, gravure coating, or gravure reverse coating. The coating amount of the thermal transfer layer is preferably from 0.1 to 2.0 g/m$^2$, more preferably from 0.2 to 1.2 g/m$^2$ (the amount is a numerical value converted to the solid content in the layer; any coating amount in the following description is a numerical value converted to the solid content unless otherwise specified). The film thickness of the dye layer is preferably from 0.1 to 2.0 μm, more preferably from 0.2 to 1.2 μm.

The dyes in the present invention must be the dyes are able to diffuse by heat and able to be incorporated in a heat-sensitive transfer sheet, and able to transfer by heat from the heat-sensitive transfer sheet to an image-receiving sheet. As the dyes that are used for the heat-sensitive transfer sheet, ordinarily used dyes or known dyes can be effectively used.

Preferable examples of the dyes that is used in the present invention include diarylmethane-series dyes, triarylmethane-series dyes, thiazole-series dyes, methine-series dyes such as merocyanine; azomethine-series dyes typically exemplified by indoaniline, acetophenoneazomethine, pyrazoloazomethine, imidazole azomethine, imidazo azomethine, and pyridone azomethine; xanthene-series dyes; oxazine-series dyes; cyanomethylene-series dyes typically exemplified by dicyanostyrene, and tricyanostyrene; thiazine-series dyes; azine-series dyes; acridine-series dyes; benzene azo-series dyes; azo-series dyes such as pyridone azo, thiophene azo, isothiazole azo, pyrrol azo, pyralazo, imidazole azo, thiadiazole azo, triazole azo, and disazo; spiropyran-series dyes; indolinospiropyran-series dyes; fluoran-series dyes; rhodaminelactam-series dyes; naphthoquinone-series dyes; anthraquinone-series dyes; and quinophthalon-series dyes.

Specific examples of the yellow dyes include Disperse Yellow 231, Disperse Yellow 201 and Solvent Yellow 93. Specific examples of the magenta dyes include Disperse Violet 26, Disperse Red 60, and Solvent Red 19. Specific examples of the cyan dyes include Solvent Blue 63, Solvent Blue 36, Disperse Blue 354 and Disperse Blue 35. As a matter of course, it is also possible to use suitable dyes other than these dyes as exemplified above.

The thermal transfer layer may have a mono-layered structure or a multi-layered structure. In the case of the multi-layered structure, the individual layers constituting the dye layer may be the same or different in composition.

The binder in the invention may be known one. Examples thereof include acrylic resins such as polyacrylonitrile, polyacrylate, and polyacrylamide; polyvinyl acetal resins such as polyvinyl acetoacetal, and polyvinyl butyral; cellulose resins such as ethylcellulose, hydroxyethylcellulose, ethylhydroxycellulose, hydroxypropylcellulose, ethylhydroxyethylcellulose, methylcellulose, cellulose acetate, cellulose acetate butyrate, cellulose acetate propionate, cellulose nitrate, other modified cellulose resins, nitrocellulose, and ethylhydroxyethylcellulose; other resins such as polyurethane resin, polyamide resin, polyester resin, polycarbonate resin, phenoxy resin, phenol resin, and epoxy resin; and various elastomers. The thermal transfer layer may be made of at least one resin selected from the above-mentioned group.

These may be used alone, or two or more thereof may be used in the form of a mixture or copolymer. These may be crosslinked with various crosslinking agents.

The binder in the invention is preferably a cellulose resin or a polyvinyl acetal resin, more preferably a polyvinyl acetal resin. In the invention, the binder resin is in particular preferably polyvinyl acetoacetal resin, or polyvinyl butyral resin.

In the invention, a transferable protective layer laminate is preferably formed in area order onto the heat-sensitive transfer sheet. The transferable protective layer laminate is used to protect a heat-transferred image with a protective layer composed of a transparent resin, thereby to improve durability such as scratch resistance, light-fastness, and resistance to weather. This laminate is effective for a case where the transferred dye is insufficient in image durability such as light resistance, scratch resistance, and chemical resistance in the state that the dye is naked in the surface of an image-receiving sheet.

The transferable protective layer laminate can be formed by forming, onto a support, a releasing layer, a protective layer and an adhesive layer in this order (i.e., in the layer-described order) successively. The protective layer may be formed by plural layers. In the case where the protective layer also has functions of other layers, the releasing layer and the adhesive layer can be omitted. It is also possible to use a base film on which an easy adhesive layer has already been formed.

As a transferable protective layer-forming resin, preferred are resins that are excellent in scratch resistance, chemical resistance, transparency and hardness. Examples of the resin include polyester resins, polystyrene resins, acrylic resins, polyurethane resins, acrylic urethane resins, silicone-modified resins of the above-described resins, ultraviolet-shielding resins, mixtures of these resins, ionizing radiation-curable resins, and ultraviolet-curing resins. Particularly preferred are polyester resins and acrylic resins. These resins may be crosslinked with various crosslinking agents.

The heat-sensitive transfer sheet according to the present invention preferably has a back side layer on the face of the base sheet opposite to the face carrying the dye layer applied (opposite face), i.e., the face in contact with the thermal head and others. Also in the case of a protective layer transferring sheet, a back side layer is preferably formed on the face of the base sheet opposite to the face carrying the applied transfer protective layer (opposite face), i.e., the face in contact with the thermal head and others.

The opposite face of the base sheet of heat-sensitive transfer sheet, when heated in direct contact with a heating device such as thermal head, often results in thermal fusion. The friction between them also becomes larger, making it difficult to convey the heat-sensitive transfer sheet smoothly during printing.

The back side layer, which is provided for the purpose of making the heat-sensitive transfer sheet resistant to the heat energy of the thermal head, prevents the thermal fusion and enables smooth travel of the heat-sensitive transfer sheet. There is an increasing need for such a layer in the recent trend toward increase in printing speed of printers and also in heat energy of the thermal heads.

The back side layer is prepared by adding a lubricant, a releasing agent, a surfactant, inorganic particles, organic particles, pigments, and others to a binder and applying the mixture. An intermediate layer may be formed between the heat-resistant lubricating layer and the base sheet. The back side layer and the intermediate layer may contain inorganic fine particles and a water-soluble resin or an emulsifiable hydrophilic resin.

The present invention will be described in more detail based on the following examples, but the invention is not intended to be limited thereto. In the following examples, the terms "part(s)" and "%" are values by mass, unless otherwise specified.

EXAMPLES

Example 1

Preparation of Heat-Sensitive Transfer Sheets

The heat-sensitive transfer sheet was prepared as follows:

A polyester film 6.0 μm in thickness (trade name: Diafoil K200E-6F, manufactured by MITSUBISHI POLYESTER FILM CORPORATION), that was subjected to an adhesion-treatment on one surface of the film, was used as a support. The following back side-layer coating solution was applied onto the support on the other surface that was not subjected to the adhesion-treatment, so that the coating amount based on the solid content after drying would be 1 g/m$^2$. After drying, the coated film was hardened by heat at 60° C.

A heat-sensitive transfer sheet was prepared by coating the following coating liquids on the easy adhesion layer coating side of the thus-prepared polyester film so that a yellow dye layer, a magenta dye layer, a cyan dye layer, and a protective layer laminate could be disposed sequentially in this area order. The coating amount of each dye layer based on the solid content was 0.8 g/m$^2$.

In the case of forming the protective layer laminate, after applying and drying of a coating liquid for a releasing layer on a substrate, a coating liquid for a protective layer was applied thereon and dried. After that, a coating liquid for an adhesive layer was applied and then dried.

| Back side layer-coating liquid | |
|---|---|
| Acrylic-series polyol resin (trade name: ACRYDIC A-801, manufactured by Dainippon Ink and Chemicals, Incorporated) | 28.0 parts by mass |
| Zinc stearate (trade name: SZ-2000, manufactured by Sakai Chemical Industry Co., Ltd.) | 0.45 part by mass |
| Phosphate (trade name: PLYSURF A217, manufactured by Dai-ichi Kogyo Seiyaku Co., Ltd.) | 1.27 parts by mass |
| Polyisocyanurate (trade name: BURNOCK D-800, manufactured by Dainippon Ink and Chemicals, Incorporated) | 8.5 parts by mass |
| Methyl ethyl ketone/toluene (2/1, at mass ratio) | 70 parts by mass |

| Yellow-dye-layer-coating liquid | |
|---|---|
| Dye compound (Y-1) | 4.2 mass parts |
| Dye compound (Y-2) | 3.7 mass parts |
| Polyvinylacetal resin (trade name: DENKA BUTYRAL #6000-AS, manufactured by DENKI KAGAKU KOGYOU K. K.) | 6.0 mass parts |
| Polyvinylbutyral resin (trade name: DENKA BUTYRAL #6000-CS, manufactured by DENKI KAGAKU KOGYOU K. K.) | 2.5 mass parts |
| Matting agent (trade name: Flo-thene UF, manufactured by Sumitomo Seika Chemicals Co., Ltd.) | 0.12 mass part |
| Methyl ethyl ketone/Toluene (2/1, at mass ratio) | 85 mass parts |

-continued

Yellow-dye-layer-coating liquid

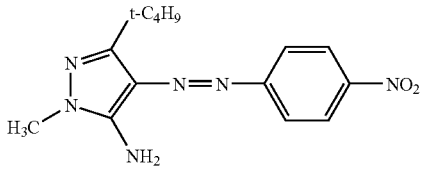

Y-1

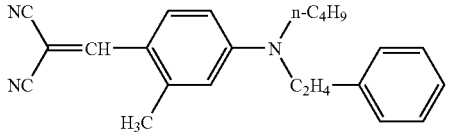

Y-2

| Magenta-dye-layer-coating liquid | |
|---|---|
| Dye compound (M-1) | 0.5 mass part |
| Dye compound (M-2) | 0.5 mass part |
| Dye compound (M-3) | 6.0 mass parts |
| Polyvinylacetal resin (trade name: DENKA BUTYRAL #6000-AS, manufactured by DENKI KAGAKU KOGYOU K. K.) | 7.0 mass parts |
| Polyvinylbutyral resin (trade name: DENKA BUTYRAL #6000-CS, manufactured by DENKI KAGAKU KOGYOU K. K.) | 1.5 mass part |
| Matting agent (trade name: Flo-thene UF, manufactured by Sumitomo Seika Chemicals Co., Ltd.) | 0.12 mass part |
| Methyl ethyl ketone/Toluene (2/1, at mass ratio) | 85 mass parts |

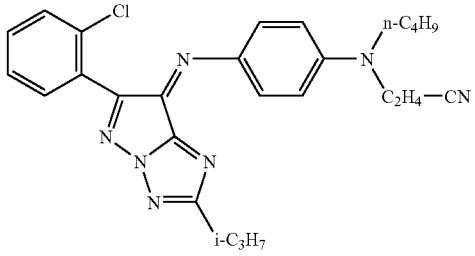

M-1

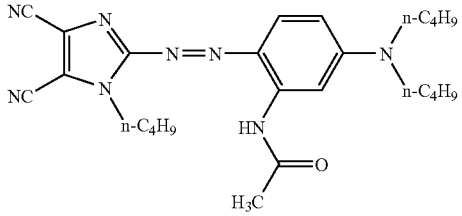

M-2

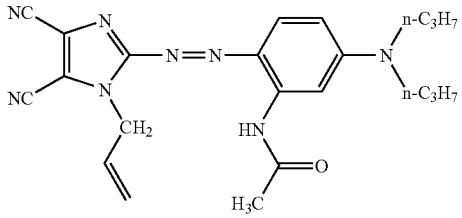

M-3

| Cyan-dye-layer-coating liquid | |
|---|---|
| Dye compound (C-1) | 1.0 mass parts |
| Dye compound (C-2) | 7.0 mass parts |
| Polyvinylacetal resin (trade name: DENKA BUTYRAL #6000-AS, manufactured by DENKI KAGAKU KOGYOU K. K.) | 7.5 mass parts |
| Polyvinylbutyral resin (trade name: DENKA BUTYRAL #6000-CS, manufactured by DENKI KAGAKU KOGYOU K. K.) | 1.0 mass part |
| Matting agent (trade name: Flo-thene UF, manufactured by Sumitomo Seika Chemicals Co., Ltd.) | 0.12 mass part |
| Methyl ethyl ketone/Toluene (2/1, at mass ratio) | 85 mass parts |

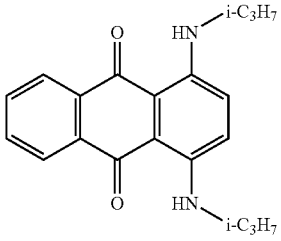

C-1

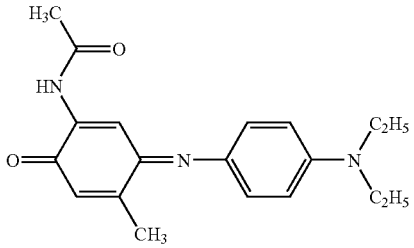

C-2

(Transfer Protective Layer Laminate)

On the same polyester film as used in the preparation of the dye layers as described above, coating liquids of a releasing layer, a protective layer and an adhesive layer each having the following composition was coated, to form a transfer protective layer laminate. Coating amounts of the releasing layer, the protective layer and the adhesive layer after drying were 0.5 g/m$^2$, 1.0 g/m$^2$ and 1.8 g/m$^2$, respectively.

| Releasing layer-coating liquid | |
|---|---|
| Modified cellulose resin (trade name: L-30, manufactured by DAICEL CHEMICAL INDUSTRIES, LTD.) | 5.0 mass parts |
| Methyl ethyl ketone | 95.0 mass parts |

| Protective layer-coating liquid | |
|---|---|
| Acrylic resin (trade name: DIANAL BR-100, manufactured by MITSUBISHI RAYON CO., LTD.) | 35 mass parts |
| Isopropanol | 75 mass parts |

| Adhesive layer-coating liquid | |
|---|---|
| Acrylic resin (trade name: DIANAL BR-77, manufactured by MITSUBISHI RAYON CO., LTD.) | 25 mass parts |
| The following ultraviolet absorber UV-1 | 1.5 mass part |

-continued

| Adhesive layer-coating liquid | |
|---|---|
| The following ultraviolet absorber UV-2 | 1.5 mass part |
| The following ultraviolet absorber UV-3 | 1.2 mass part |
| The following ultraviolet absorber UV-4 | 0.8 mass part |
| Silicone resin particles (trade name: TOSPEARL 120, manufactured by MOMENTIVE Performance Materials Japan LLC.) | 0.06 mass parts |
| Methyl ethyl ketone/Toluene (2/1, at mass ratio) | 70 mass parts |

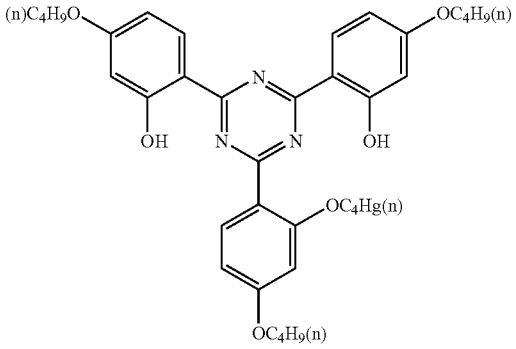

(UV-1)

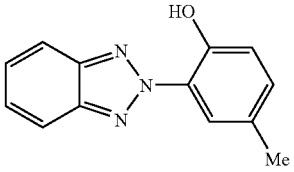

(UV-2)

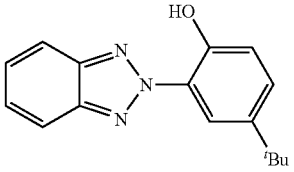

(UV-3)

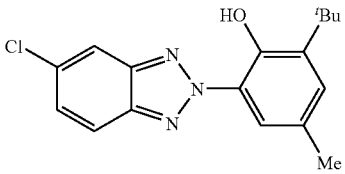

(UV-4)

(Preparation of a Heat Sensitive Image-Receiving Sheet)

Samples 101 to 107 were prepared by the following means.

A paper support, on both sides of which polyethylene was laminated, was subjected to corona discharge treatment on the surface thereof, and then a gelatin undercoat layer containing sodium dodecylbenzenesulfonate was disposed on the treated surface. A subbing layer, an heat insulation layer and a receptor layer each having the following composition were simultaneously multilayer-coated on the gelatin undercoat layer, in the state that the subbing layer, the heat insulation layer and the receptor layer were laminated in this order from the side of the support, by a method illustrated in FIG. 9 in U.S. Pat. No. 2,761,791. The coating was performed so that coating amounts of the subbing layer, the heat insulation layer and the receptor layer after drying would be 6.5 g/m$^2$, 9.0 g/m$^2$ and 5.5 g/m$^2$, respectively. The film surface temperature at the time of drying was in the range of 22.0° C. to 28.5° C. The film surface temperature was measured by using a radiation thermometer (IT-340, manufactured by HORIBA, Ltd.).

The following compositions are presented by mass parts as solid contents.

| Receptor layer | |
|---|---|
| Latex polymer (Table 1) | 25.0 mass parts |
| Additive (Table 1) | 1.0 mass parts |
| Gelatin (10% solution) | 3.0 mass parts |
| Hardener (B-1) | 0.01 mass parts |
| The following surfactant F-2 | 0.36 mass part |

| Heat insulation layer | |
|---|---|
| Hollow latex polymer particles (trade name: MH5055, manufactured by Nippon Zeon Co., Ltd.) | 65.0 mass parts |
| Gelatin (10% solution) | 30.0 mass parts |
| Hardener (B-1) | 0.1 mass parts |

| Subbing layer | |
|---|---|
| Polyvinyl alcohol (trade name: POVAL PVA 205, manufactured by Kuraray) | 7.0 mass parts |

-continued

| Subbing layer | |
|---|---|
| Styrene butadiene rubber latex (trade name: SN-307, manufactured by NIPPON A & L INC) | 60.0 mass parts |
| The following surfactant F-1 | 0.03 mass part |

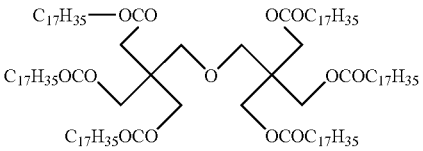

(EW-1)

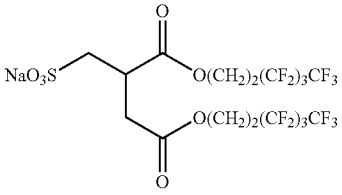

(F-1)

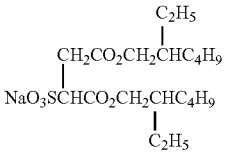

(F-2)

(B-1) Sodium salt of 4,6-dichloro-2-1,3,5-triazine

TABLE 1

Heat-sensitive transfer image-receiving sheet

| Sample No. | Latex polymer | Tg | Additive | Compound classification |
|---|---|---|---|---|
| 101 | Vinybran 900 trade name: manufactured by Nissin Chemicals Co., Ltd. | 70° C. | none | none |
| 102 | Vinybran 609 trade name: manufactured by Nissin Chemicals Co., Ltd. | 46° C. | EW-1 | Non-fluorine aliphatic compound; nonionic and water-insoluble |
| 103 | Vinybran 609 trade name: manufactured by Nissin Chemicals Co., Ltd. | 46° C. | Megafac F-477 trade name: manufactured by Dainippon Ink and Chemicals, Ltd. | Polymer compound having a fluorine atom-substituted aliphatic group at its side chain; nonionic and water-soluble |
| 104 | Vinybran 609 trade name: manufactured by Nissin Chemicals Co., Ltd. | 46° C. | Megafac F-472SF trade name: manufactured by Dainippon Ink and Chemicals, Ltd. | Polymer compound having a fluorine atom-substituted aliphatic group at its side chain; nonionic and water-soluble |
| 105 | Vinybran 276 trade name: manufactured by Nissin Chemicals Co., Ltd. | 33° C. | Megafac F-483 trade name: manufactured by Dainippon Ink and Chemicals, Ltd. | Polymer compound having a fluorine atom-substituted aliphatic group at its side chain; nonionic and water-insoluble |
| 106 | Vylonal MD-1100 trade name: manufactured by Toyobo Co., Ltd. | 40° C. | Megafac F-483 trade name: manufactured by Dainippon Ink and Chemicals, Ltd. | Polymer compound having a fluorine atom-substituted aliphatic group at its side chain; nonionic and water-insoluble |
| 107 | Vylonal MD-1100 trade name: manufactured by Toyobo Co., Ltd | 40° C. | Megafac F-479 trade name: manufactured by Dainippon Ink and Chemicals, Ltd. | Polymer compound having a fluorine atom-substituted aliphatic group at its side chain; nonionic and water-soluble |

The heat-sensitive transfer image-receiving sheet described in the following Patent Document was also prepared as Sample 108.

Sample 108: heat-sensitive transfer image-receiving sheet described in an Example of JP-A No. 2006-88691

Receiving polymer: Vilonal MD-1200 trade name, manufactured by Toyobo Co., Ltd. (Tg: 67° C.)

Additive: FC-4430, trade name, manufactured by Sumitomo 3M Ltd.

(Evaluation)

Fuji Film thermal photoprinter ASK-2000L (trade name) manufactured by Fuji Photo Film Co., Ltd. was used as the printer for evaluation of image-forming methods. Using the aforementioned heat-sensitive transfer sheet and heat-sensitive transfer image-receiving sheet, ten (10) sheets of the image having a size of 127 nm×89 mm were output from the printer. The non-uniformity of density owing to the crack was evaluated by using a gradation image ranging from white to max gray. With respect to the presence of the white deletion at a low density portion (reflection density of about 0.3) or the non-uniformity of density at a high density portion (reflection density of about 1.8), each of which is caused by the crack on the output image, these evaluations were performed according to the following criteria. A smaller crack achieves a better evaluation.

(White Deletion at Low Density Portion)

5: No white deletion at a low density portion is found in the image, and there is no problem in practice.

4: Slight white deletion at a low density portion is found in such a degree that no one pays attention to it, and there is no problem in practice.

3: Some white deletions at a low density portion are found, and there is a problem in practice.

2: At a low density portion, no crack is found by naked eye, but a lot of white deletions are found, and there is a problem in practice.

1: At a low density portion, not only cracks are found by naked eye, but also a lot of white deletions are found, and there is a problem in practice.

(Non-Uniformity of Density at High Density Portion)

5: No non-uniformity of density at a high density portion is found, and there is no problem in practice.

4: Slight non-uniformity of density at a high density portion is found, but there is no problem in practice.

3: Some non-uniformities of density at a high density portion are found, and there is a problem in practice.

2: A lot of non-uniformities of density are found at a high density portion, and there is a problem in practice.

1: A lot of non-uniformities of density together with cracks are found at a high density portion, and there is a problem in practice.

(Evaluation Results)

TABLE 2

| Experimental No. | Remarks | Heat-sensitive transfer image-receiving sheet sample number | White deletion at low density portion owing to crack | Non-uniformity of density at high density portion owing to crack |
|---|---|---|---|---|
| 1 | Comparative example | 101 | 1 | 2 |
| 2 | Comparative example | 102 | 2 | 3 |
| 3 | This invention | 103 | 4 | 4 |
| 4 | This invention | 104 | 5 | 5 |
| 5 | This invention | 105 | 4 | 5 |
| 6 | This invention | 106 | 4 | 5 |
| 7 | This invention | 107 | 5 | 5 |
| 8 | Comparative example | 108 | 2 | 3 |

Example 2

On the same support as used in the preparation of Sample 101 as described above, coating liquids of a subbing layer, an insulation layer, a lower receptor layer and an upper receptor layer each having the following composition was coated, to form a heat-sensitive transfer image-receiving sheet 201. Coating amounts of the subbing layer, a heat insulation layer, a lower receptor layer and an upper receptor layer after drying were 6.7 g/m$^2$, 8.7 g/m$^2$, 2.6 g/m$^2$ and 2.7 g/m$^2$, respectively. The temperature at the time of drying was in the range of 22.2° C. to 28.2° C.

| Upper receptor layer | |
|---|---|
| Vinyl chloride-series latex (trade name: Vinybran 276, manufactured by Nissin Chemicals Co., Ltd.) | 23 mass parts |
| Gelatin (10% solution) | 2.0 mass parts |
| The above ester-series wax EW-1 | 2.0 mass parts |
| The above surfactant F-1 | 0.07 mass part |
| The above surfactant F-2 | 0.36 mass part |
| Additive (trade name: Megafac F-472SF manufactured by Dainippon Ink and Chemicals, Ltd.) | 1.0 mass parts |

| Lower receptor layer | |
|---|---|
| Vinyl chloride-series latex (trade name: Vinybran 609, manufactured by Nissin Chemicals Co., Ltd.) | 24.0 mass parts |
| Gelatin (10% solution) | 10.0 mass parts |
| The following surfactant F-1 | 0.04 mass part |

| Heat insulation layer | |
|---|---|
| Hollow latex polymer particles (trade name: MH5055, manufactured by Nippon Zeon Co., Ltd.) average particle diameter 0.5 μm hollow ratio 55% Tg = 105° C. | 60.0 mass parts |
| Styrene butadiene latex (trade name: LX415M, manufactured by Nippon Zeon Co., Ltd.; Tg = 27° C.) | 11.0 mass parts |

| Subbing layer | |
|---|---|
| Polyvinyl alcohol (trade name: POVAL PVA 205, manufactured by Kuraray) | 6.7 mass parts |
| Styrene butadiene rubber latex (trade name: SN-307, manufactured by NIPPON A & L INC) | 60.1 mass parts |
| The above surfactant F-1 | 0.03 mass part |
| The above hardener (B-1) | 0.1 mass part |

Samples 202 to 205 were prepared in the same manner as Sample 201, except that the upper receptor layer was replaced by the following upper receptor layer, respectively. (Sample 202)

| Upper receptor layer | |
|---|---|
| Vinyl chloride-series latex (trade name: Vinybran 276, manufactured by Nissin Chemicals Co., Ltd.) | 23 mass parts |
| Gelatin (10% solution) | 2.0 mass parts |
| The above ester-series wax EW-1 | 2.0 mass parts |
| The above surfactant F-1 | 0.07 mass part |
| The above surfactant F-2 | 0.36 mass part |
| Additive (trade name: Megafac F-472SF manufactured by Dainippon Ink and Chemicals, Ltd.) | 0.5 mass parts |
| Additive (trade name: Megafac F-479 manufactured by Dainippon Ink and Chemicals, Ltd.) | 0.5 mass parts |

(Sample 203)

| Upper receptor layer | |
|---|---|
| Vinyl chloride-series latex (trade name: Vinybran 276, manufactured by Nissin Chemicals Co., Ltd.) | 23 mass parts |
| Gelatin (10% solution) | 2.0 mass parts |
| The above ester-series wax EW-1 | 2.0 mass parts |
| The above surfactant F-1 | 0.07 mass part |
| The above surfactant F-2 | 0.36 mass part |
| Additive (trade name: Zonyl FSH manufactured by DuPont) | 0.5 mass parts |
| Additive (trade name: Megafac F-479 manufactured by Dainippon Ink and Chemicals, Ltd.) | 0.5 mass parts |

(Sample 204)

| Upper receptor layer | |
|---|---|
| Vinyl chloride-series latex (trade name: Vylonal MD-1100, manufactured by Toyobo Co., Ltd.) | 23 mass parts |
| Gelatin (10% solution) | 2.0 mass parts |
| The above ester-series wax EW-1 | 2.0 mass parts |
| The above surfactant F-1 | 0.07 mass part |
| The above surfactant F-2 | 0.36 mass part |
| Additive (trade name: Megafac F-472SF manufactured by Dainippon Ink and Chemicals, Ltd.) | 0.5 mass parts |

-continued

| Upper receptor layer | |
|---|---|
| Additive (trade name: Megafac F-479 manufactured by Dainippon Ink and Chemicals, Ltd.) | 0.5 mass parts |

(Sample 205)

| Upper receptor layer | |
|---|---|
| Vinyl chloride-series latex (trade name: Vinybran 276, manufactured by Nissin Chemicals Co., Ltd.) | 23 mass parts |
| Gelatin (10% solution) | 2.0 mass parts |
| The above ester-series wax EW-1 | 2.0 mass parts |
| The above surfactant F-1 | 0.07 mass part |
| The above surfactant F-2 | 0.36 mass part |
| Additive (trade name: Zonyl FSH manufactured by DuPont) | 0.33 mass parts |
| Additive (trade name: Megafac F-477 manufactured by Dainippon Ink and Chemicals, Ltd.) | 0.33 mass parts |
| Additive (trade name: Megafac F-479 manufactured by Dainippon Ink and Chemicals, Ltd.) | 0.33 mass parts |

(Sample 206)

Sample 206 was prepared in the same manner as Sample 201, except that the upper receptor layer and the lower receptor layer were replaced by the following upper receptor layer and the following lower receptor layer, respectively.

| Upper receptor layer | |
|---|---|
| Vinyl chloride-series latex (trade name: Vinybran 276, manufactured by Nissin Chemicals Co., Ltd.) | 23 mass parts |
| Gelatin (10% solution) | 2.0 mass parts |
| The above ester-series wax EW-1 | 2.0 mass parts |
| The above surfactant F-1 | 0.07 mass part |
| The above surfactant F-2 | 0.36 mass part |
| Additive (trade name: Megafac F-472SF manufactured by Dainippon Ink and Chemicals, Ltd.) | 0.5 mass parts |

| Lower receptor layer | |
|---|---|
| Vinyl chloride-series latex (trade name: Vinybran 609, manufactured by Nissin Chemicals Co., Ltd.) | 24.0 mass parts |
| Gelatin (10% solution) | 10.0 mass parts |
| The above surfactant F-1 | 0.04 mass part |
| Additive (trade name: Megafac F-479 manufactured by Dainippon Ink and Chemicals, Ltd.) | 0.5 mass parts |

Evaluations were performed in the same manner as in Example 1 with respect to the heat-sensitive transfer image-receiving sheet samples 201 to 206. As a result, it was found that the usage of two kinds of polymers having a fluorine aliphatic group at its side chain in combination made the effects of the present invention enhance.

The results are shown in the following Table 3.

TABLE 3

| Experimental No. | Remarks | Heat-sensitive transfer image-receiving sheet sample number. | White deletion at low density portion owing to crack | Non-uniformity of density at high density portion owing to crack |
|---|---|---|---|---|
| 1 | This invention | 201 | 5 | 5 |
| 2 | This invention | 202 | 5 | 5 |
| 3 | This invention | 203 | 5 | 5 |

TABLE 3-continued

| Experimental No. | Remarks | Heat-sensitive transfer image-receiving sheet sample number. | White deletion at low density portion owing to crack | Non-uniformity of density at high density portion owing to crack |
|---|---|---|---|---|
| 4 | This invention | 204 | 4 | 5 |
| 5 | This invention | 205 | 5 | 5 |
| 6 | This invention | 206 | 5 | 5 |

As is apparent from the above-described Table 3, it is understood that there are neither white deletion at a low density portion, nor non-uniformity of density at high density portion, each of which is caused by the crack. In addition, on account that there is no transfer irregularity of the protective layer, it is seen that a high quality image can be obtained by the samples of the present invention.

Having described our invention as related to the present embodiments, it is our intention that the invention not be limited by any of the details of the description, unless otherwise specified, but rather be construed broadly within its spirit and scope as set out in the accompanying claims.

This non-provisional application claims priority under 35 U.S.C. §119 (a) on Patent Application No. 2008-016968 filed in Japan on Jan. 28, 2008, which is entirely herein incorporated by reference.

What we claim is:

1. A heat-sensitive transfer image-receiving sheet having at least one heat insulation layer and at least one receptor layer on a support, the heat insulation layer containing hollow polymeric particles, and the receptor layer containing at least one latex polymer having the glass transition temperature (Tg) of 20° C. to 60° C. and at least one polymer compound having an aliphatic group substituted with a fluorine atom at its side chain.

2. The heat-sensitive transfer image-receiving sheet according to claim 1, wherein the polymer compound having fluorine atom-substituted aliphatic groups on the side chains is nonionic.

3. The heat-sensitive transfer image-receiving sheet according to claim 1, wherein the polymer compound having fluorine atom-substituted aliphatic groups on the side chains is soluble in water.

4. The heat-sensitive transfer image-receiving sheet according to claim 1, wherein the receptor layer further contains a water-soluble polymer.

5. The heat-sensitive transfer image-receiving sheet according to claim 1, wherein the polymer latex is a vinyl chloride-series copolymer.

6. The heat-sensitive transfer image-receiving sheet according to claim 1, wherein at least one layer constituting the heat-sensitive transfer image-receiving sheets contains a hardener.

7. The heat-sensitive transfer image-receiving sheet according to claim 1, wherein the heat insulation layer contains at least one polymer having the glass transition temperature (Tg) of 20° C. to 80° C.

* * * * *